United States Patent [19]

Sluyterman

[11] Patent Number: 4,710,671

[45] Date of Patent: Dec. 1, 1987

[54] COLOR TELEVISION DISPLAY TUBE WITH COMA CORRECTION

[75] Inventor: Albertus A. S. Sluyterman, Eindhoven, Netherlands

[73] Assignee: U.S. Philips Corporation, New York, N.Y.

[21] Appl. No.: 872,771

[22] Filed: Jun. 10, 1986

[30] Foreign Application Priority Data

Jun. 12, 1985 [NL] Netherlands ..... 8501687
Oct. 9, 1985 [NL] Netherlands ..... 8502746

[51] Int. Cl.[4] ..... H01J 29/51; H01J 29/76
[52] U.S. Cl. ..... 313/413; 313/412
[58] Field of Search ..... 313/412, 413, 414, 409

[56] References Cited

U.S. PATENT DOCUMENTS 4,196,370 4/1980 Hughes ..... 313/412 X
4,396,862 8/1983 Hughes ..... 313/413

*Primary Examiner*—Leo H. Boudreau
*Assistant Examiner*—K. Wieder
*Attorney, Agent, or Firm*—Robert J. Kraus

[57] ABSTRACT

A color television display tube including an electron gun system (5) in an evacuated envelope for generating three electron beams whose axes are co-planar. The beams converge on a display screen (10) provided on a wall of the envelope and are deflected in the operative display tube across the display screen into two orthogonal directions. The electron gun system (5) has correction elements for causing the rasters scanned on the display screen by the electron beams to coincide as much as possible. The correction elements include annular elements (34) of a material having a high magnetic permeability which are positioned around the two outer beams. In addition a further correction element (38, 38'', 38''') of a material having a high magnetic permeability is provided around the central beam in a position located further from the screen in order to correct field coma errors at the ends of the vertical axis and in the corners to an equal extent. The further element is preferably positioned in, or on the screen side of, the area of the focusing gap of the electron gun.

9 Claims, 16 Drawing Figures

COLOR TELEVISION DISPLAY TUBE WITH COMA CORRECTION

BACKGROUND OF THE INVENTION

The invention relates to a colour television display tube comprising an electron gun system of the "in-line" type in an evacuated envelope for generating three electron beams. The beam axes are co-planar and converge on a display screen provided on a wall of the envelope while the beams are deflected across the display screen into two orthogonal directions by means of a first and a second deflection field. The electron gun system is provided with field shapers for causing the rasters scanned on the display screen by the electron beams to coincide as much as possible. The field shapers comprise elements of a magnetically permeable material positioned around the two outer beams and placed adjacent the end of the electron gun system closest to the screen.

A colour television display tube of this type is known from U.S. Pat. No. 4,196,370. A frequent problem in colour television display tubes incorporating an electron gun system of the "in-line" type is what is commonly referred to as the line and field coma error. This error becomes manifest in that the rasters scanned by the three electron beams on the display screen are spatially different. This is due to the eccentric location of the outer electron beams relative to the fields for horizontal and vertical deflection, respectively. The Patent cited above sums up a large number of patents giving partial solutions. These solutions consist of the use of field shapers. These are magnetic field conducting and/or protective rings and plates mounted on the extremity of the gun system which locally strengthen or weaken the deflection field or the deflection fields along part of the electron beam paths.

In colour television display tubes various types of deflection units may be used for the deflection of the electron beams. These deflection units may form self-convergent combinations with tubes having an "in-line" electron gun system. One of the frequently used deflection unit types is what is commonly referred to as the hybrid deflection unit. It comprises a saddle line deflection coil and a toroidal field deflection coil. Due to the winding technique used for manufacturing the field deflection coil it is not possible to make the coil completely self-convergent. Usually such a winding distribution is chosen that a certain convergence error remains, which is referred to as field coma. This coma error becomes clearly noticeable in a larger raster (vertical) for the outer beams relative to the central beam. The vertical deflection of the central beam is smaller than that of the outer beams. As has been described, inter alia, in the U.S. Pat. No. 4,196,370 cited above, this may be corrected by providing elements of a material having a high magnetic permeability (for example, mu-metal) around the outer beams. The peripheral field is slightly shielded by these elements at the area of the outer electron beams so that these beams are slightly less deflected and the field coma error is reduced.

A problem which presents itself is that the correction of the field coma (Y-coma) is anisotropic. In other words, the correction in the corners is less than the correction at the end of the vertical axis. This is caused by the positive "lens" action of the line deflection coil (approximately, quadratic with the line deflection) for vertical beam displacements. (The field deflection coil has a corresponding lens action, but it does not contribute to the relevant anisotropic effect). The elimination of such an anisotropic Y-coma error by adapting the winding distribution of the coils is a cumbersome matter and often introduces an anisotropic X-coma.

SUMMARY OF THE INVENTION

It is an object of the invention to provide a display tube in which it is possible to correct field coma errors on the vertical axis and in the corners to an equal extent without requiring notable adaptation of the winding distribution of the coils.

To this end a display tube of the type described in the opening paragraph is characterized in that the elements placed at the display screen end of the electron gun system are constructed to overcorrect field coma errors and that the field shapers comprise a further element positioned around the central electron beam at an area of the electron gun system further away from the display screen which operates oppositely to the elements at the end.

The invention is based on the recognition of the fact that the problem of the anisotropic Y-coma can be solved by suitably utilizing the Z-dependence of the anisotropic Y-coma.

This dependence implies that as the coma correction is effected at a larger distance (in the Z-direction) from the "lens" constituted by the line deflection coil the operation of said "lens" becomes more effective, so that the coma correction acquires a stronger anisotropic character. With the coma correction means placed around the outer beams at the gun extremity closest to the screen, the coma is the overcompensated to such a large extent that it is overcorrected even in the corners. The coma is then heavily overcorrected on the vertical axis. The correction is anisotropic. A stronger anisotropic anti-correction is brought about by performing an anti-coma correction at a still greater distance from the lens. By adding this stronger anisotropic anti-correction the coma on the vertical axis can be reduced to zero without the coma in the corners becoming anisotropic. The coma on the vertical axis and the corners is then corrected to an equal extent.

The further element may have the basic shape of a ring and may be mounted around the central aperture of an apertured electrode partition. However, restrictions then are imposed on the positioning of the further element. As will be further described hereinafter, there will be more freedom in the positioning of the further element when in accordance with a preferred embodiment of the invention the further element comprises two strips of a magnetically permeable material which extend parallel to and symmetrically relative to the plane through the electron beam axis around the axis of the central beam.

The effectiveness of these strips may be improved under circumstances when according to a further embodiment of the invention their extremities are provided with outwardly projecting lugs.

The strips may further be separate components or form one assembly with a magnetic material cup-shaped part of the electron gun system, which facilitates mounting.

An effective embodiment of the invention is characterized in that the further element is positioned in, or in front of, the area of the focusing gap of the electron gun. This may be realized in that the further element consists of a ring of magnetically permeable material which is mounted around the central aperture of an apertured partition in the focussing electrode.

The principle of the invention is realised in a given case in that the field shapers adjacent the display screen facing end of the electron gun system consist of two rings mounted on the apertured lid of a box-shaped centering bush, while the further element in that case may advantageously consist of a ring of magnetically permeable material which is mounted around the central aperture in the bottom of the centering bush.

The display tube according to the invention is very suitable for use in a combination with a deflection unit of the hybrid type, particularly when a combination is concerned which should be free from raster correction.

BRIEF DESCRIPTION OF THE DRAWING

The invention will now be further described by way of example, with reference to the accompanying drawing figures in which.

DESCRIPTION OF THE PREFERRED EMBODIMENTS

Figure 1:
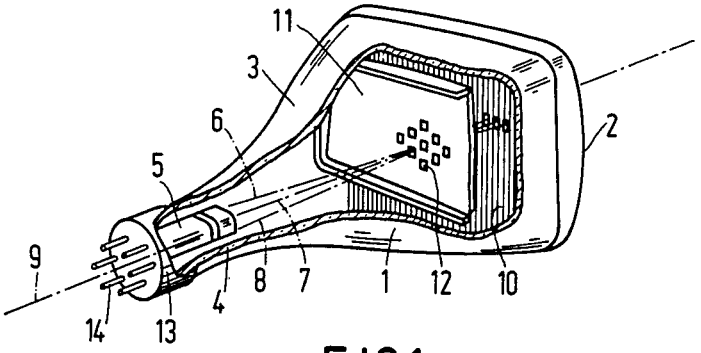
FIG. 1 is a perspective broken-up elevational view of a display tube according to the invention.

FIG. 1 is a perspective elevational view of a display tube according to the invention. It is a colour television display tube of the "in-line" type. In a glass envelope 1, which is composed of a display window 2, a cone 3 and a neck 4, this neck accommodates an integrated electron gun system 5 generating three electron beams 6, 7 and 8 whose axes are co-planar prior to deflection. The axis of the central electron beam 7 coincides with the tube axis 9. The inside of the display window 2 is provided with a large number of triplets of phosphor elements. These elements may be dot shaped or line shaped. Each triplet comprises an element consisting of a blue-luminescing phosphor, an element consisting of a green-luminescing phosphor and an element consisting of a red-luminescing phosphor. All triplets combined constitute the display screen 10. Positioned in front of the display screen is a shadow mask 11 having a very large number of (elongated) apertures 12 which allow the electron beams 6, 7 and 8 to pass, each beam impinging only on respective phosphor elements of one colour. The three co-planar electron beams are deflected by a system of deflection coils not shown. The tube has a base 13 with connection pins 14.

Figure 2:
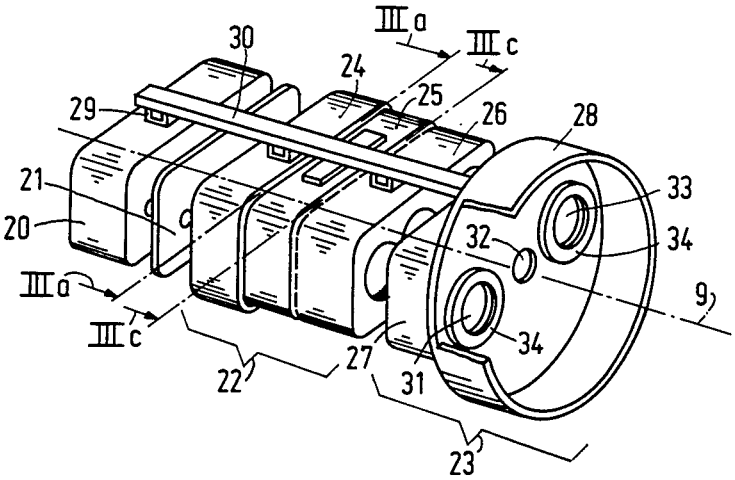
FIG. 2 is a perspective elevational view of an electron gun system for a tube as shown in FIG. 1.

FIG. 2 is a perspective elevational view of an embodiment of an electron gun system as used in the colour television display tube of FIG. 1. The electron gun system has a common cup-shaped electrode 20, in which three cathodes (not visible in the Figure) are secured, and a common plate-shaped apertured grid 21. The three electron beams whose axes are co-planar are focused with the aid of a focussing electrode 22 and an anode 23 which are common for the three electron beams. Focussing electrode 22 consists of three cup-shaped parts 24, 25 and 26. The open ends of parts 25 and 26 are connected together. Part 25 is coaxially positioned relative to part 24. Anode 24 has one cup-shaped part 27 whose bottom, likewise as the bottoms of the other cup-shaped parts, is apertured. Anode 23 also includes a centering bush 28 used for centering the electron gun system in the neck of the tube. This centering bush is provided for that purpose with centering springs not shown. The electrodes of the electron gun system are connected together in a conventional manner with the aid of brackets 29 and glass rods 30.

The bottom of the centering bush 28 has three apertures 31, 32 and 33. Substantially annular field shapers 34 are provided around the apertures 31 and 33 for the outer electron beams. The centering bush is for example 6.5 mm deep and has an external diameter of 22.1 mm and an internal diameter of 21.6 mm in a tube having a neck diameter of 29.1 mm. The distance between the centers of two adjacent apertures in the bottom is 6.5 mm. The annular elements 34 are punched from 0.40 mm thick mu-metal sheet material. (Conventional elements generally have a thickness of 0.25 mm).

Figure 3A:
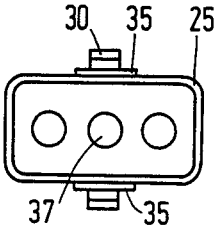
FIG. 3*a* is an elevational view of a vertical cross-section through part of FIG. 2.

FIG. 3*a* is an elevational view of a vertical cross-section through the cup-shaped part 25 of the electron gun system of FIG. 2 in which the plane through the beam axes is perpendicular to the plane of the drawing. Two (elongated) strips 35 of a magnetically permeable material such as mu-metal are provided symmetrically relative to the aperture 37 for the central electron beam.

Figure 3B:
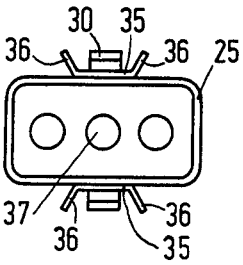
FIG. 3*b* is a cross-section analogous to FIG. 3*a* of a further embodiment according to the invention.

FIG. 3*b* shows a cross-section analogous to the cross-section of FIG. 3*a* of a further embodiment of the strips 35. In this case each strip has projecting lugs 36.

The strips 35 which produce a coma correction in a direction opposite to the direction of the coma correction produced by the elements 34 are shown as separate components secured to the focussing electrode 22 (for example, by means of spotwelding). If the cup-shaped part 24 has a magnetic shielding function and is therefore manufactured of a magnetically permeable material, the strips 35 may be formed in an alternative manner as projections on the cup-shaped part 24.

Figure 3C:
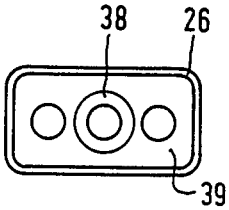
FIG. 3*c* is a cross-section analogous to FIG. 3*a* of a further embodiment according to the invention.

FIG. 3*c* is an elevational view of a cross-section at a different area through the anode 22 in an alternative embodiment of the electron gun system of FIG. 2. In this alternative embodiment the strips 35 are absent. They have been replaced by an annular element 38 of a magnetically permeable material positioned around the center beam. The annular element 38 is provided on an additional apertured partition 39 accommodated between the cup-shaped parts 25 and 26.

In this embodiment there is a restriction that such an additional partition cannot be accommodated in any arbitrary position. The embodiments shown in FIGS. 3*a* and 3*b* do not have such a restriction. The strips 35 may be provided in any axial position of the component 22 dependent on the effect to be attained. A plurality of variants based on the embodiment shown in FIG. 3*c* is, however, possible. For this purpose reference is made to FIG. 6.

The effect of the invention is demonstrated with reference to FIG. 4. In FIG. 4*a* the rasters of the outer electron beams (red and blue) and the central beam (green) are shown by means of a solid and a broken line, respectively, in a display tube without field shapers and provided with a self-convergent deflection coil. The reference bc indicates the field coma.

Figure 4A:
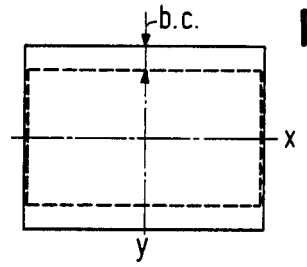
FIGS. 4*a, b, c* and *d* show the field coma occurring in the different deflection units.
Figure 4B:
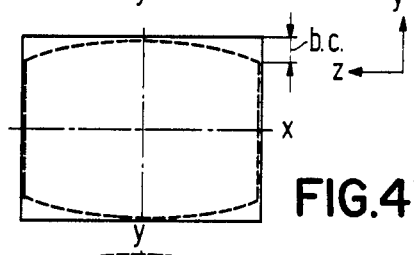
FIG. 4*e* illustrates the compensation of the field coma according to the invention.

Correction of the coma with the means hitherto known results in the situation shown in FIG. 4*b*. The field coma is zero at the ends of the Y-axis (the vertical axis or picture axis), but in the corners the field coma is still not zero.

Figure 4C:
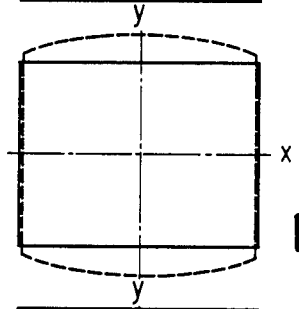

Overcompensation of the field coma causes the situation shown in FIG. 4*c*. Overcompensation is realised, for example, by adapting the external diameter of the annular elements 34 shown in FIG. 2, or by placing them further to the front.

A coma correction in the opposite direction is realised with the aid of the elements 35 or the element 38 in a position located further to the rear in the electron gun system. The effect of this "anti"-coma correction by itself is shown in FIG. 4*d*.

Figure 4D:
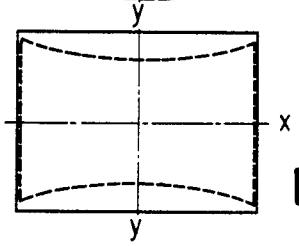
Figure 4E:
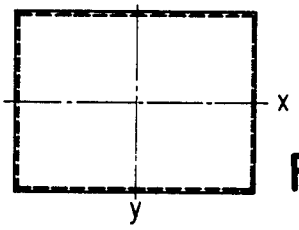

The combined effect of the corrections as shown in FIGS. 4*c* and 4*d* is shown in FIG. 4*e*. The effect of the invention can clearly be seen; the field coma is corrected to an equal extent on the vertical axis and in the corners.

Figure 5A:
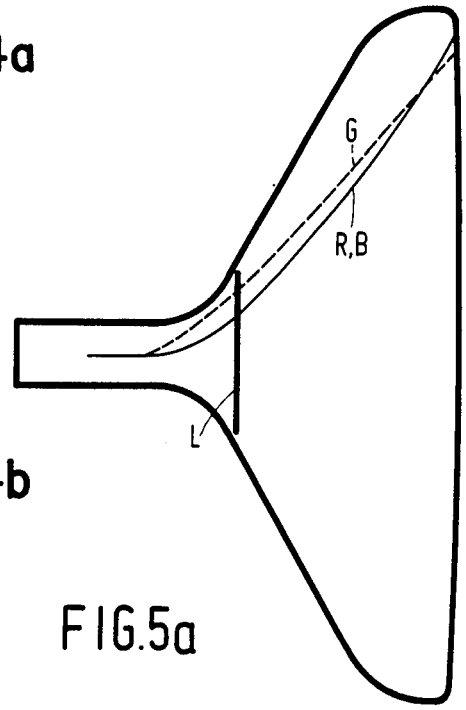
FIG. 5*a* schematically shows the beam path on deflection in a conventional dislay tube, and FIG. 5*b* schematically shows the beam path on deflection in a display tube according to the invention.

Elaboration of the step according to the invention on the beam path of the electron beams in a display tube is illustrated with reference to FIGS. 5*a* and *b*. FIG. 5*a* is a longitudinal section through a display tube 40 in which the outer electron beams R, B and the central electron beam G are deflected in a conventional manner. The reference L indicates the position where the "lensing action" of the deflection coils is thought to be concentrated. Upon generating a change in direction, a displacement ($\Delta Y$) of the outer beams relative to the central beam occurs in the "lens".

Figure 5B:
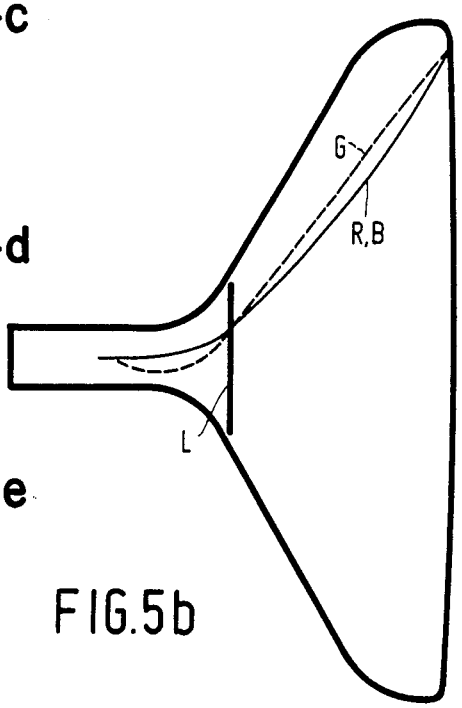

The step according to the invention ensures that there is no displacement in the lens of the outer beams relative to the central beam when generating a change in direction (FIG. 5*b*).

When using an annular element provided around the central aperture in an apertured partition, such as the element 38, for ensuring an anti-coma correction, there are different manners of positioning the element in a suitable place in addition to the manner of positioning previously described with reference to FIG. 3*c*. Some of these manners are shown with reference to FIGS. 6*a*, *b*, *c* and *d* showing longitudinal sections through different electron gun systems suitable for use in a display tube according to the invention. The plane through the axes of the electron beams is in the plane of the drawing.

Figure 6A:
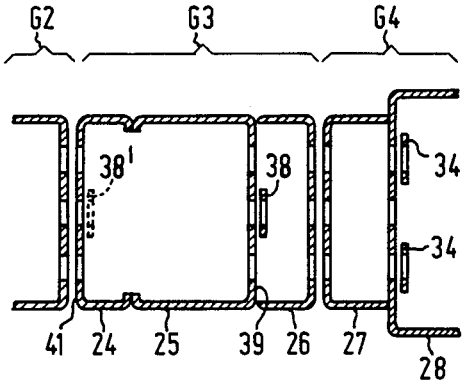
FIGS. 6*a, b, c* and *d* are longitudinal sections of different embodiments of an electron gun system for a display tube according to the invention.

FIG. 6*a* shows the same situation as FIG. 3*c*. An additional apertured partition 39 on which a ring 38 of a magnetically permeable material is mounted around the central aperture is provided between the parts 25 and 26 of the focussing electrode 22 (G3). If no additional partition 39 is to be accommodated, it is possible to provide an anti-coma correction ring 38' around the central aperture on the bottom 41 of the cup-shaped part 24. However, one should then content oneself with the effect that is produced by the ring positioned in this particular place.

Figure 6B:
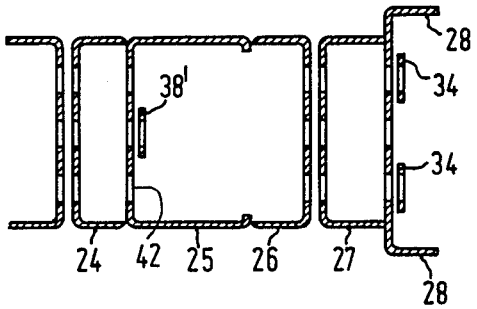

As FIG. 6*b* shows, an alternative manner is to provide an additional partition 42 between the electrode parts 24 and 25 and mount a ring 38' of a magnetically permeable material on it. This is, however, only possible when the cup-shaped part 24 does not have a shielding function.

Figure 6C:
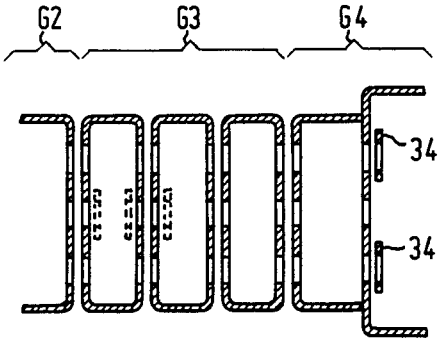
Figure 6D:
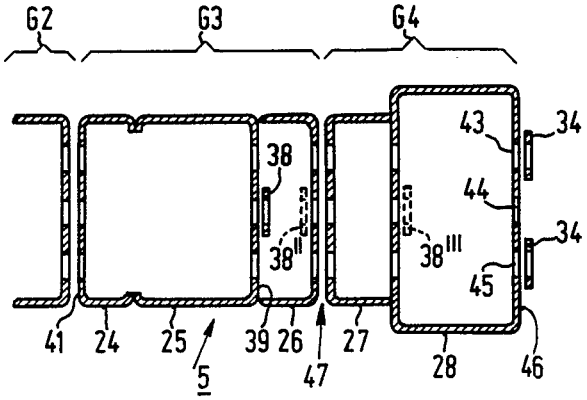

There is a greater variation in the positioning possibilities of the anti-coma correction element when the electron gun system is of the multistage type, as is shown in FIG. 6*c*. Broken lines show that one or more rings of a megnetically permeable material may be provided in different positions around the axis of the central beam.

The closer the correction elements 34 around the outer beams are placed towards the display screen, the better it is in most cases. To meet this purpose, an electron gun system having a special type of centering bush as shown in the electron gun system of FIG. 6*d* can be used. In that case the centering bush 28 is box-shaped and provided with an apertured end 46 on the side facing the display screen.

The apertured end 46 has three apertures 43, 44 and 45. Rings 34 of a magnetically permeable material are mounted on the outside of the end 46 at the aperture 43 and 45 for the outer beams. An optimum position, viewed in the longitudinal direction of the electron gun system, can then always be found for the ring 38 of a magnetically permeable material which is to be positioned around the central beam. This may be the position of ring 38 in FIG. 6*d*, but also a more advanced position indicated by the ring 38''. Even a still more advanced position indicated by ring 38''' is possible. Generally, a position of the ring around the central beam in, or in front of the area of the focusing gap 47 of the electron gun, that is to say, in or in front of the area of the transition from part 26 to part 27 is very suitable. The rings around the outer beams should then be located further to the front, into the direction of the display screen.

What is claimed is:

1. A color display tube comprising an envelope containing a display screen, and an electron gun system for producing a central electron beam and first and second outer electron beams having respective axes which lie in a single plane and converge toward a point on the screen, the electron gun system including an end from which the electron beams exit into a deflection field region of the envelope where a field deflection field effects deflection of the beams in a direction perpendicular to said plane and a line deflection field effects deflection of the beams in a direction parallel to said plane, said line deflection field producing a positive lens action;

characterized in that the electron gun system includes field coma-correcting means comprising:

(a) first and second deflection field shaping means of magnetically-permeable material arranged adjacent the respective outer electron beams, at the end of the electron gun system, for cooperating with the positive lens action of the line deflection field to anisotropically overcorrect the field coma error of said outer electron beams relative to that of the central electron beam; and (b) a third deflection field shaping means of magnetically-permeable material arranged adjacent the central electron beam, at a position in the electron gun system further from the screen than the first and second field shaping means, for cooperating with the positive lens action of the line deflection field to reverse-anisotropically correct the field coma error of the central electron beam by an amount sufficient to compensate for the overcorrection by the first and second field shaping means, thereby effecting production of a central-electron-beam- produced raster which is substantially identical to the outer-electron-beam-produced rasters.

2. A color display tube comprising an envelope containing a display screen, and an electron gun system for producing a central electron beam and first and second outer electron beams having respective axes which lie in a single plane and converge toward a point on the screen, the electron gun system including at an end thereof a first plate-shaped part including a central and first and second outer apertures from which the respective electron beams exit into a deflection field region of the envelope where a field deflection field effects deflection of the beams in a direction perpendicular to said plane and a line deflection field effects deflection of the beams in a direction parallel to said plane, said line deflection field producing a positive lens action;

characterized in that the electron gun system includes field coma-correcting means comprising:

(a) first and second deflection field shaping means of magnetically-permeable material arranged adjacent the respective outer apertures in the first plate-shaped part for cooperating with the positive lens action of the line deflection field to anisotropically overcorrect the field coma error of said outer electron beams relative to that of the central electron beam; and (b) a third deflection field shaping means of magnetically-permeable material arranged adjacent a central aperture in a second plate-shaped part of the electron gun for passing the central electron beam, at a position in the electron gun system further from the screen than the first plate-shaped part, for cooperating with the positive lens action of the line deflection field to reverse-anisotropically correct the field coma of the central electron beam by an amount sufficient to compensate for the overcorrection by the first and second field shaping means, thereby effecting production of a central-electron-beam-produced raster which is substantially identical to the outer-electron-beam-produced rasters.

3. A color display tube as in claim 1 or 2 where the third deflection field shaping means comprises first and second strips of magnetically permeable material extending parallel to and symmetrically disposed on opposite sides of said plane.

4. A color display tube as in claim 3 where each of said first and second strips of magnetically permeable material include at opposite ends thereof projecting lugs which extend away from said plane.

5. A color display tube as in claim 3 where the first and second strips of magnetically permeable material comprise integrally formed portions of a cup-shaped portion of the electron gun system, which itself consists essentially of magnetically permeable material.

6. A color display tube as in claim 1 or 2 where the third deflection field shaping means is disposed adjacent an electron-beam-focusing electrode of the electron gun system.

7. A color display tube as in claim 1 or 2 where the first and second deflection field shaping means are disposed on an apertured plate-shaped member closing an end of a centering bush for centering the electron gun system in a neck of the envelope.

8. A color display tube as in claim 7 where the first and second deflection field shaping means comprise ring-shaped elements disposed around respective first and second apertures of said plate-shaped member on a side thereof closer to the screen, and where the third deflection field shaping means comprises a ring-shaped element disposed around a central aperture of said plate-shaped member on a side thereof which is further from said screen.

9. A color display tube as in claim 6 where the third deflection field shaping means comprises a ring-shaped member surrounding a central aperture in the electron-beam-focusing electrode.

* * * * *